United States Patent [19]

Gitman

[11] Patent Number: 4,494,927

[45] Date of Patent: Jan. 22, 1985

[54] CENTRALIZED LADLE HEATING AND DRYING SYSTEM

[75] Inventor: Grigory M. Gitman, Duluth, Ga.

[73] Assignee: The Cadre Corporation, Atlanta, Ga.

[21] Appl. No.: 493,248

[22] Filed: May 10, 1983

Related U.S. Application Data

[63] Continuation-in-part of Ser. No. 418,798, Sep. 16, 1982, Pat. No. 4,432,726.

[51] Int. Cl.[3] ..... F27D 3/00; F24J 3/00; C21B 9/00

[52] U.S. Cl. ..... 432/9; 75/46; 266/141; 432/224

[58] Field of Search ..... 75/46; 266/141; 432/9, 432/224, 225

[56] References Cited

U.S. PATENT DOCUMENTS

| | | | |
|---|---|---|---|
| 1,373,688 | 4/1921 | Vergniaud | 432/9 |
| 1,458,350 | 6/1923 | McDermott | 432/224 |
| 4,229,211 | 10/1980 | Battles | 432/224 |
| 4,432,726 | 2/1984 | Gitman | 432/9 |

*Primary Examiner*—John J. Camby
*Attorney, Agent, or Firm*—Thomas & Kennedy

[57] ABSTRACT

Several ladles (11–14) for receiving hot metals are preheated by applying a lid (40, 42) to the rim of each ladle and directing an open flame through the lid into the ladle. The hot exhaust gases move back through the lid and through a heat exchanger (35–38) to heat the oncoming combustion air, and the exhaust gases from the ladles being preheated are combined and directed through a lid (41) applied to a ladle at a drying station to dry the ladle.

32 Claims, 11 Drawing Figures

CENTRALIZED LADLE HEATING AND DRYING SYSTEM

CROSS REFERENCE TO RELATED APPLICATION

This is a continuation-in-part of U.S. patent application Ser. No. 418,798 filed Sept. 16, 1982 now U.S. Pat. No. 4,432,726.

BACKGROUND OF THE INVENTION

This invention relates to a system for simultaneously preheating at least one ladle to a relatively high temperature and curing another ladle at a lower temperature, wherein an open flame is directed into the ladles being preheated and the exhaust gases from the ladles being preheated are directed to the ladle being cured.

In the ferrous and nonferrous molten metals industries, ladles and similar metal receivers receive a charge of hot molten metal and transport the metal to a remote location for pouring the metal into a mold, or into a casting machine, etc. The receivers usually are lined with refractory material such as brick, and it is desirable to preheat the receiver before the hot molten metal is poured into the receiver in order to avoid interface solidification of the hot metal upon contact between the metal and a relatively cool interior surface of the receiver, and also to avoid thermal shock to the refractory liner of a relatively cool receiver, thus avoiding deterioration of the liner. When preheating ladles for the receipt of molten metal, it is desirable to preheat the ladles to temperatures as high as about 2400° F. when the ladles are to receive molten steel or other molten ferrous materials. By preheating the ladle or other receiving chamber before pouring the metal in the ladle, significant heat loss from the molten metal to the ladle is avoided as the metal is transported in the ladle from the furnace to the pouring position.

The prior art procedures for preheating ladles and other molten metal receivers prior to charging the ladles with molten metal included directing an open, natural gas flame into the open chamber of the ladle. This open flame heating method permitted the hot combustion gases generated by the open flame to escape from within the ladle chamber to the surrounding atmosphere, thereby wasting heat energy.

Recently, a more economical system has been developed for preheating ladles, whereby a lid with a soft ceramic fiber face is applied to the rim of the ladle to be preheated to form a seal at the rim of the ladle, an open gas flame is projected from the lid into the ladle, and the exhaust gases are directed from the ladle back through the lid and through a heat exchanger which preheats the oncoming combustion air. This type of system is disclosed in U.S. Pat. No. 4,229,211 issued Oct. 21, 1980.

When a ladle has been rebuilt as by replacing the refractory brick at the interior surface of the ladle, before the ladle can be used it is necessary to dry or "cure" the ladle by slowly heating the interior of the ladle. The temperature of the refractory must be raised slowly in order to avoid cracking of the refractory during the drying procedure. Preferably, the temperature of the flame or other heat source within a ladle which is being dried should start at first from about 200° F. and be raised slowly up to a temperature in excess of 1000° F. Again, a prior art procedure for drying or curing ladles has been to direct an open gas flame into the ladle; however, this prior art procedure also is not economical in that the hot gases of combustion are lost to the atmosphere and it is difficult to control the temperature of the refractory surface within the ladle.

In a metal casting plant it is not uncommon to preheat several ladles to high temperatures while at the same time one or more other ladles which have been rebricked are being dried and further cured at lower temperatures.

SUMMARY OF THE INVENTION

Briefly described, the present invention comprises a centralized ladle heating and drying system whereby ladles and similar receivers of the type utilized to receive molten metals are preheated while other receivers are dried, by creating an open flame or other heat source in the ladles to be preheated to increase the temperature of the ladle up to about 2400° F. and utilizing the hot exhaust gases from the ladle that is being preheated to heat a ladle that is to be dried. A heat exchanger and a lid for closing a ladle are used at each ladle preheating station, whereby the lid engages the rim of the ladle to close the ladle, combustion air is directed through the heat exchanger where it is preheated, then through the lid and through a burner and into the ladle, fuel is added to the combustion air and the mixture of fuel and combustion air is burned in the ladle to raise the temperature of the ladle. The hot exhaust gases are directed back through the lid of the ladle and through the heat exchanger. The hot exhaust gases from one or more heat exchangers are combined and are directed to a ladle drying station. The ladle drying station includes a lid that is to be applied to the rim of a rebricked ladle that is to be dried, and the hot exhaust gases from the heat exchangers at the heating stations are directed through the lid of the ladle at the drying station to heat and dry the ladle. The temperature of the hot exhaust gases entering the ladle at the drying station is adjusted by adding a controlled amount of dilution air at ambient temperature to the hot exhaust gases entering the ladle, so that the temperature of the uncured refractory of the drying ladle can be raised slowly from about 200° F. to a temperature in excess of 1000° F. to dry and further cure the ladle.

In the preferred embodiment of the invention, at least two ladle preheating stations will be provided for each ladle drying station, so that continuous drying of an uncured ladle can be maintained at the ladle drying station by directing the hot exhaust gases from one ladle preheating station to the ladle drying station while the preheating function at the other of the ladle preheating stations can be terminated while the preheated ladle is removed and a cold ladle is substituted for the preheated ladle.

In one embodiment of the invention the heat exchanger is mounted directly on and supported by the lid of the assembly at the ladle preheating stations, and the ladles are moved beneath and then lifted up into contact with the lid so as to close the lid over the rim of the ladle. In another embodiment of the invention the lid which is to be applied to the rim of the ladle at the preheating station is movable with respect to its heat exchanger and when a ladle is placed in position at the ladle preheating station, the lid is moved with respect to its heat exchanger toward contact with the rim of the ladle to close the ladle.

In some instances the ladles being preheated will have accumulated slag about the ladle rims, and some of the ladle rims will have been chipped or cracked so that the ladle rims are not smooth. When a lid is applied to the rim of a ladle that has protrusions or cracks, etc, the lid might not form a seal against the ladle rim. To accommodate an imperfect seal against a ladle rim the system includes a blower at the ladle drying station which draws the hot gases of combustion from the ladle heating stations, from the ladles being heated, through their lids and through the heat exchanger, and moves the gases to the ladle drying station, through the lid at the drying station and into the ladle being dried. This applies a negative pressure at the ladle heating stations so that the hot gases of combustion will not be lost to the atmosphere through the imperfect seal applied to the ladle rims but will be drawn into the heat exchanger and ultimately used in the ladle drying process. Moreover, the atmospheric air drawn into the system about the imperfect seal at the rims of the ladles at the ladle heating stations will add to the mass of gases moving through the heat exchanger and into the ladle being dried. Thus, more gas turbulence is present in the system, thereby enhancing heat exchange and compensating for the loss of temperature by the addition of atmospheric air to the hot gases of combustion.

Thus, it is an object of this invention to provide a centralized ladle heating and drying system for simultaneously preheating and curing ladles and similar receivers of the type that handle hot molten metals, wherein the exhaust gases from the ladles that are being preheated are utilized to provide heat energy for increasing the temperature of the oncoming combustion air and to provide the heat energy for drying uncured ladles.

Another object of this invention is to provide a centralized ladle heating and drying system which is capable of economically preheating ladles to a temperature in excess of 2000° F., and which uses a centralized heat recuperator for preheating oncoming combustion air and which simultaneously dries or cures other ladles by utilizing the collected hot combustion gases from the ladles being preheated as the lower temperature heat source for the drying process.

Another object of this invention is to provide a centralized ladle heating and drying system in which a group of ladle preheating stations is arranged adjacent at least one ladle curing station, and in which air and fuel can be mixed to form an open flame at each ladle preheating station for the purpose of preheating ladles, and wherein the hot exhaust gases from ladles at the ladle preheating stations are directed through separated sections of a centralized recuperator and to the ladle drying station and the gases are utilized as the heat source for drying a ladle at the ladle drying station.

Another object of this invention is to provide a centralized ladle heating system which includes a group of ladle heating stations and wherein air and fuel are mixed to form a flame in the ladle of at least one heating station and the exhaust gases are directed from that ladle to a second ladle heating station and directed into the ladle at the second ladle heating station for heating the ladle.

Another object of this invention is to provide an economical method of simultaneously preheating ladles to a relatively high temperature and simultaneously drying other ladles to a lower temperature.

Other objects, features and advantages of this invention will become apparent upon reading the following specification, when taken in conjunction with the accompanying drawings.

DETAILED DESCRIPTION

Figure 1:
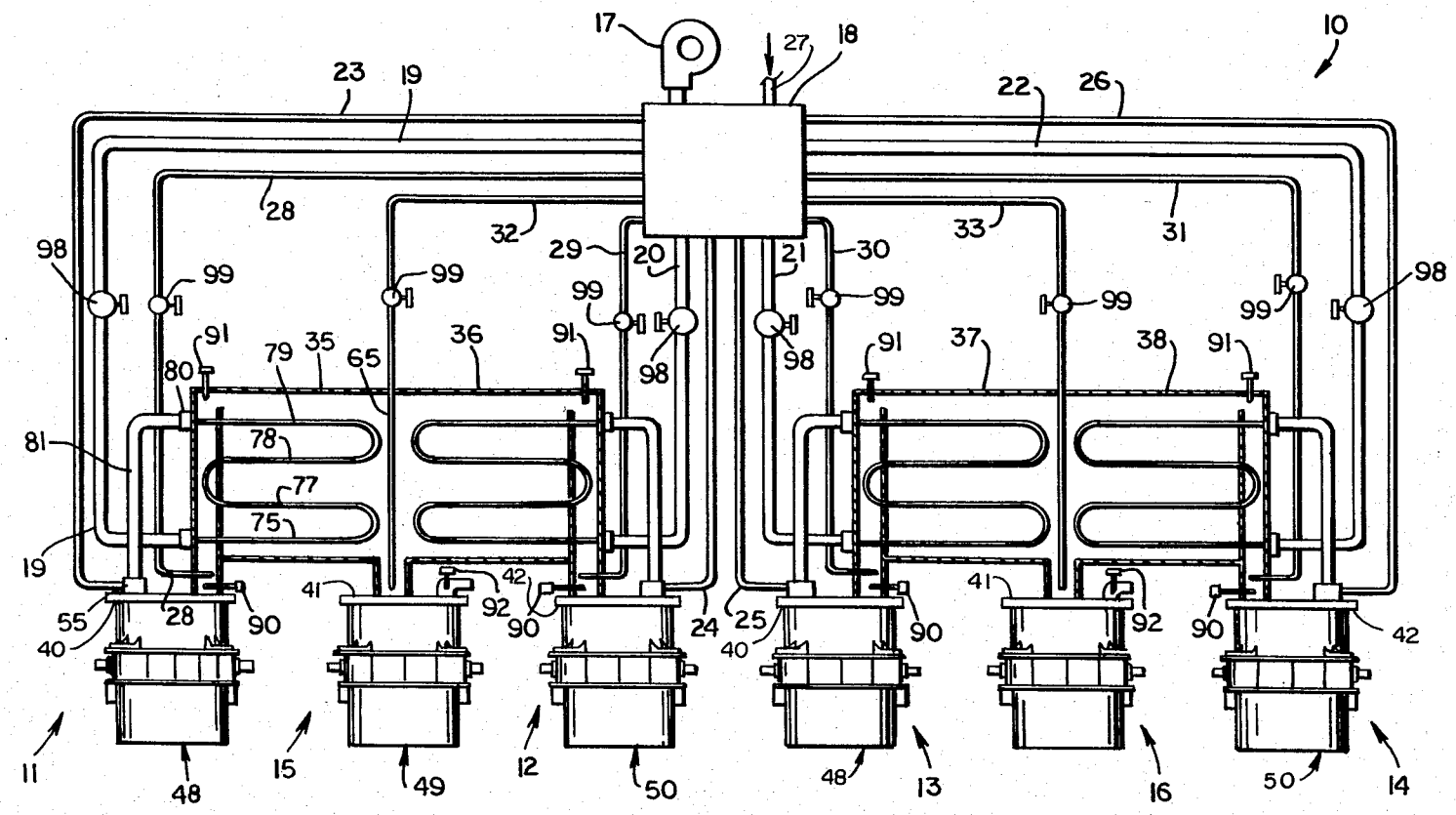
FIG. 1 is a schematic elevational view of the centralized ladle heating and drying system.

Referring now in more detail to the drawings, in which like numerals indicate like parts throughout the several views, FIG. 1 illustrates a centralized ladle heating and drying system 10 which comprises a pluraility of ladle preheating stations 11, 12, 13, and 14 and a plurality of ladle drying stations 15 and 16. Fuel-air control system 18 directs combustion air from blower 17 through conduits 19, 20, 21 and 22, provides natural gas or other fuel from supply 27 through gas conduits 23, 24, 25 and 26 and dilution air through dilution air conduits 28, 29, 30 and 31 to each of the ladle preheating stations 11–14. In addition, the fuel-air control 18 provides dilution air through dilution air conduits 32 and 33 to the ladle drying stations 15 and 16.

A heat exchanger 35, 36, 37 and 38 is provided for each ladle preheating station 11–14, respectively. In the embodiment illustrated in FIGS. 1, 2 and 3, heat exchangers 35 and 36 are structurally combined, and hollow partition 65 separates the heat exchangers. The dilution air conduit 32 directs cool air through the partition 65 between heat exchangers 35 and 36. Heat exchangers 37 and 38 are constructed in a similar manner.

Figure 2:
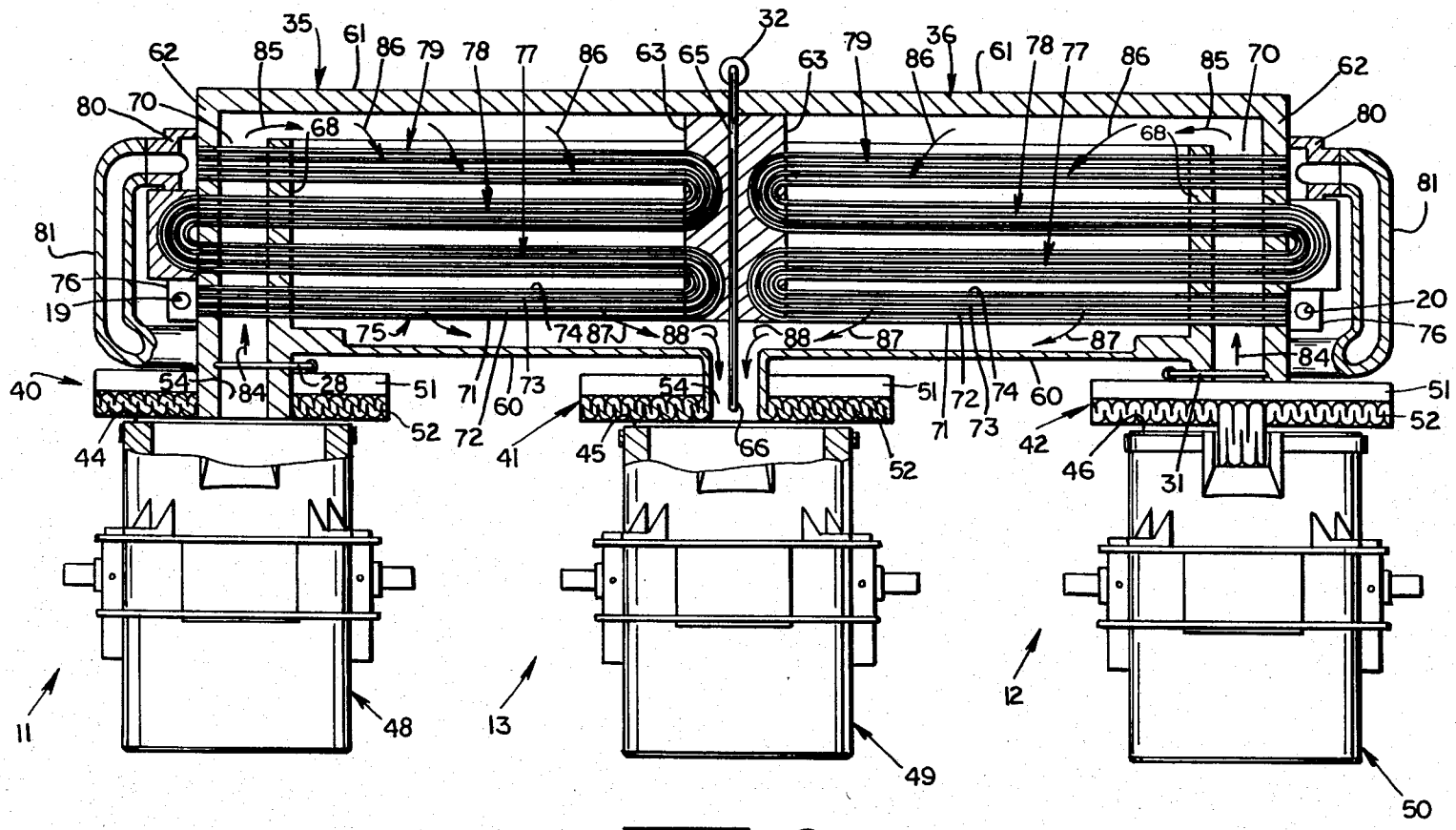
FIG. 2 is a side elevational view, with portions shown in cross-section, of part of a centralized ladle heating and drying system.
Figure 3:
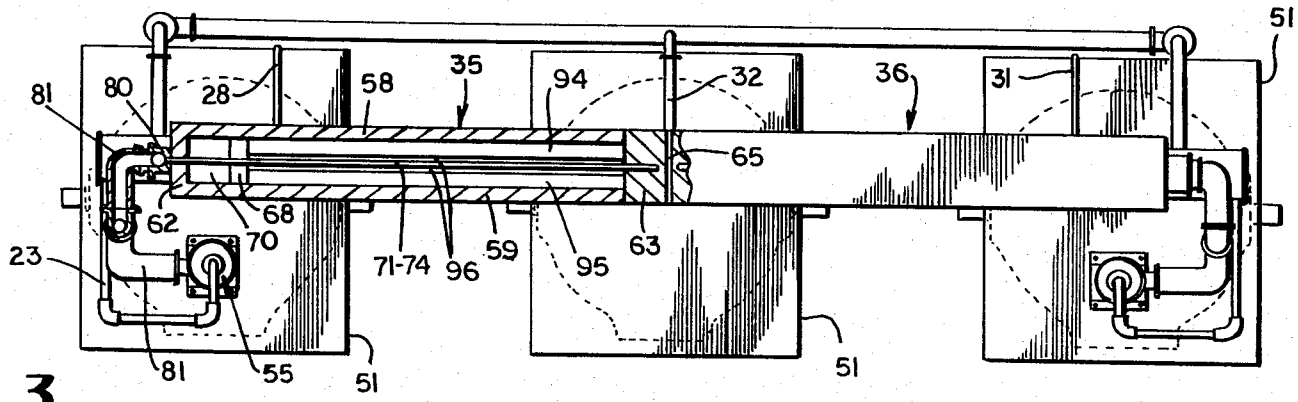
FIG. 3 is a top view of the ladle heating and drying system of FIG. 2, with portions shown in cross-section.

As illustrated in more detail in FIGS. 2 and 3, the heat exchangers 35 and 36 are rigidly mounted to ladle lids 40, 41 and 42 which are to be applied to the rims 44, 45 and 46 of the ladles 48, 49 and 50. The ladle lids 40–42 are generally similar to the ladle lids illustrated in U.S. Pat. No. 4,229,211, and each comprises a support shell or framework 51 and a soft refractory fiber seal surface 52 supported in the shell 51 and facing downwardly toward the rim of a ladle therebelow. An opening 54 is formed in each lid for the movement therethrough of hot gases. Burners 55 (FIG. 3) are mounted on each lid at a preheating station 11–14 for receiving the fuel and combustion air and directing the mixture of fuel and combustion air through the lids at the preheating stations so as to generate a flame that is directed inwardly of the ladles at the preheating stations. The exhaust gases from the ladles at each preheating station are directed through opening 54 of its lid, through the heat exchangers 35, 36 and then through opening 54 and into the ladle 13 at the drying station. The exhaust gases from the ladle at a drying station are moved back through an opening (not shown) in the ladle lid and are directed upwardly through a flue (not shown) to the atmosphere.

The heat exchangers 35 and 36 are similar to each other and each includes vertical side walls 58 and 59 (FIG. 3), bottom wall 60 (FIG. 2), top wall 61 and end walls 62 and 63. The end wall 63 of each heat exchanger 35 and 36 abuts the hollow partition 65 that functions as a conduit and is connected at its upper portion to dilution air conduit 32 and which extends at its lower end 66 partially through the opening 54 of ladle lid 41, thereby also functioning as a partition within the opening 54. Internal upright partitions 68 are located adjacent each end wall 62, forming a passageway 70 with the end wall 62 that registers with the opening 54 extending through the ladle lid 40, 42. The passageway 70 directs the exhaust gases from the ladle engaging the ladle lid 40, 42 upwardly through the lid and into the upper portion of the heat exchange chamber.

A plurality of heat exchange conduits 71, 72, 73 and 74 are supported in a serpentine arrangement within each chamber of the heat exchangers. The lower bank 75 of conduit sections extends through partition 68 and end wall 62 and communicates at one end with header 76. Header 76 is connected to combustion air conduit 19 or 20, so that combustion air is supplied through conduit 19 or 20 to header 76 and then into the open ends of the lower bank of heat exchange conduit 71–74. The lower bank 75 is supported at its opposite end in end wall 63 and makes a 180° turn to form the second bank 77, with the second bank of conduits being supported at its end by end wall 63 at one end, and by partition 68 and end wall 62 at its other end. The other end of the bank 77 of heat exchange conduits 71–74 extends through end wall 62 and turns 180° and then extends back through end wall 62, partition 68 and the opposite end wall 63 to form the third bank 78 of heat exchange conduits. Similarly, the third bank of heat exchange conduits turns through 180° in end wall 63 to form the fourth bank 79, and the fourth bank of heat exchange conduits communicates with header 80 which is mounted to end wall 62, and conduit 81 directs the combustion air from header 80 downwardly through insulated conduit 81 to burner 55 (FIG. 3).

With the arrangement as illustrated in FIGS. 2 and 3, it will be noted that the combustion air is received from a combustion air conduit 19, 20, 21 or 22 in a header 76 at each heat exchanger 35, 36, 37 or 38, and the combustion air then moves through the banks 75, 77, 78 and 79 of heat exchange conduits in a serpentine path through the interior of the heat exchanger, the combustion air then leaves the heat exchange conduits and passes through header 80, conduit 81 to burner 55 where fuel from a fuel supply conduit 23, 24, 25 or 26 is mixed with the combustion air, and the mixture is passed through the lid of the ladle and burned within the ladle. In the meantime, the gases of combustion are directed by the opening 54 and passageway 70 through the lid applied to the ladle and into the heat exchange chamber about the heat exchange conduits 71–74 in the directions as indicated by flow arrows 84, 85, 86, 87 and 88 to opposite sides of the hollow partition 65 and downwardly through opening 54 extending through ladle lid 41 and into ladle 49 that is at the ladle drying station 15. The heat of the exhaust gas from the ladles being heated at the ladle preheating stations 11, 12, 13 and 14 is transferred to the oncoming combustion air in the heat exchangers. Typically, the exhaust gases moving out of a ladle being preheated will be from about 500° to about 2400° F., and after the exhaust gases pass through a heat exchanger 35, 36, 37 or 38 the temperature of the exhaust gases can be up to approximately 1200° F. Thermocouples 90, 91 and 92 (FIG. 1) are positioned in the exhaust gas flow stream so as to detect the temperature of the exhaust gases, and the thermocouples control the volume of dilution air that is moved through the dilution air conduits 32 and 33 to the opening 54 at the ladle drying station 15 and 16, so that the exhaust gas temperature will be adjusted as necessary to be compatible with the ladle being dried.

For example, the ladle being dried should receive exhaust gases at a temperature of approximately 200° F. at the beginning of the drying process, and the temperature should be raised slowly to a level in excess of 1000° F. Therefore, a large volume of dilution air will pass through the dilution air partition 65 at the beginning of the drying procedure so as to effectively lower the temperature of the exhaust gases entering the ladle at the drying station, and the volume of the dilution air moving into the ladle at the drying station will be decreased progressively so that the effective temperature of the exhaust gases moved into the ladle at the drying station is increased progressively.

As illustrated in FIG. 3, it will be noted that layers of heat insulation material 94 and 95 extend vertically adjacent the vertical side walls 58 and 59 of the heat exchangers 35, 36, 37 and 38 on opposite sides of the banks 75–79 of heat exchange conduits 71–74 so as to form a narrow passage 96 about the heat exchange conduits 71–74. This causes the exhaust gases from each ladle at a ladle preheating station to move closely about the heat exchange conduits and to move at high velocities about the heat exchange conduits, thereby enhancing the exchange of heat between the exhaust gases outside the conduits 1–74 and the combustion air inside the conduits 71–74.

In addition to the dilution air supplied to the ladles 49 at the drying stations 15, 16, dilution air also can be added to the exhaust gases in the passageway 70 by the dilution air conduits 28, 29, 30 and 31. The supply of the cooler dilution air at this position avoids overheating the heat exchange conduits 71–74 in each heat exchanger above about 1850° F.

In the embodiment illustrated in FIGS. 2 and 3, the ladle lids 40, 41 and 42 are stationary and the heat exchangers 35 and 36 are mounted directly on the ladle lids. When a ladle is to be heated or dried, the ladle is moved beneath a ladle lid and then elevated so that its rim engages the soft seal material 52 of the ladle lid. When the system is in operation with a ladle at each ladle preheating station 11, 12, 13 and 14 and with a ladle at each drying station 15 and 16, and when one of the ladle at a preheating station has been properly preheated and is to be removed from the ladle preheating station, the fuel supply and combustion air supply to the ladle to be removed is terminated, and the hot ladle is lowered out of contact with its lid and the ladle is removed from the vicinity of the ladle preheating station. In the meantime, the other ladle preheating stations which are still in operation and which communicate with the drying station continue to supply hot exhaust gases to the ladle at the drying station, so that the ladle at the drying station continues to be dried. A cold ladle can be moved into abutment with the ladle lid at the vacant ladle preheating station, and the preheating cycle can be commenced, by initiating the flow of combustion air and fuel through the burner and igniting the mixture of fuel and combustion air.

Flow control valves 98 are located in the combustion air supply conduits 19, 20, 21 and 22 (FIG. 1), while flow control valves 99 are located in the dilution air conduits 28, 29, 30, 31, 32 and 33, to regulate the supply of air to the system and to control the temperatures of the system.

Figure 5:
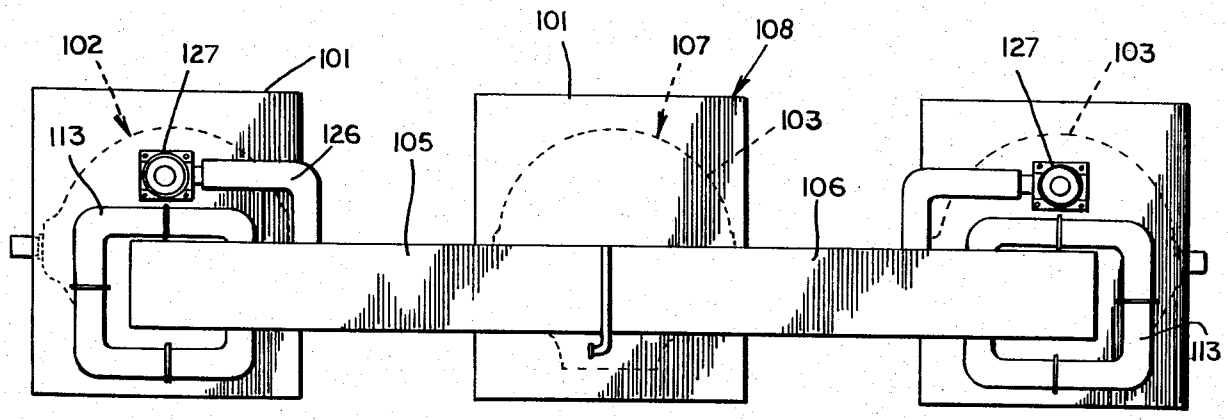
FIG. 5 is a top view of the portion of the centralized ladle heating and drying system of FIG. 4.
Figure 4:
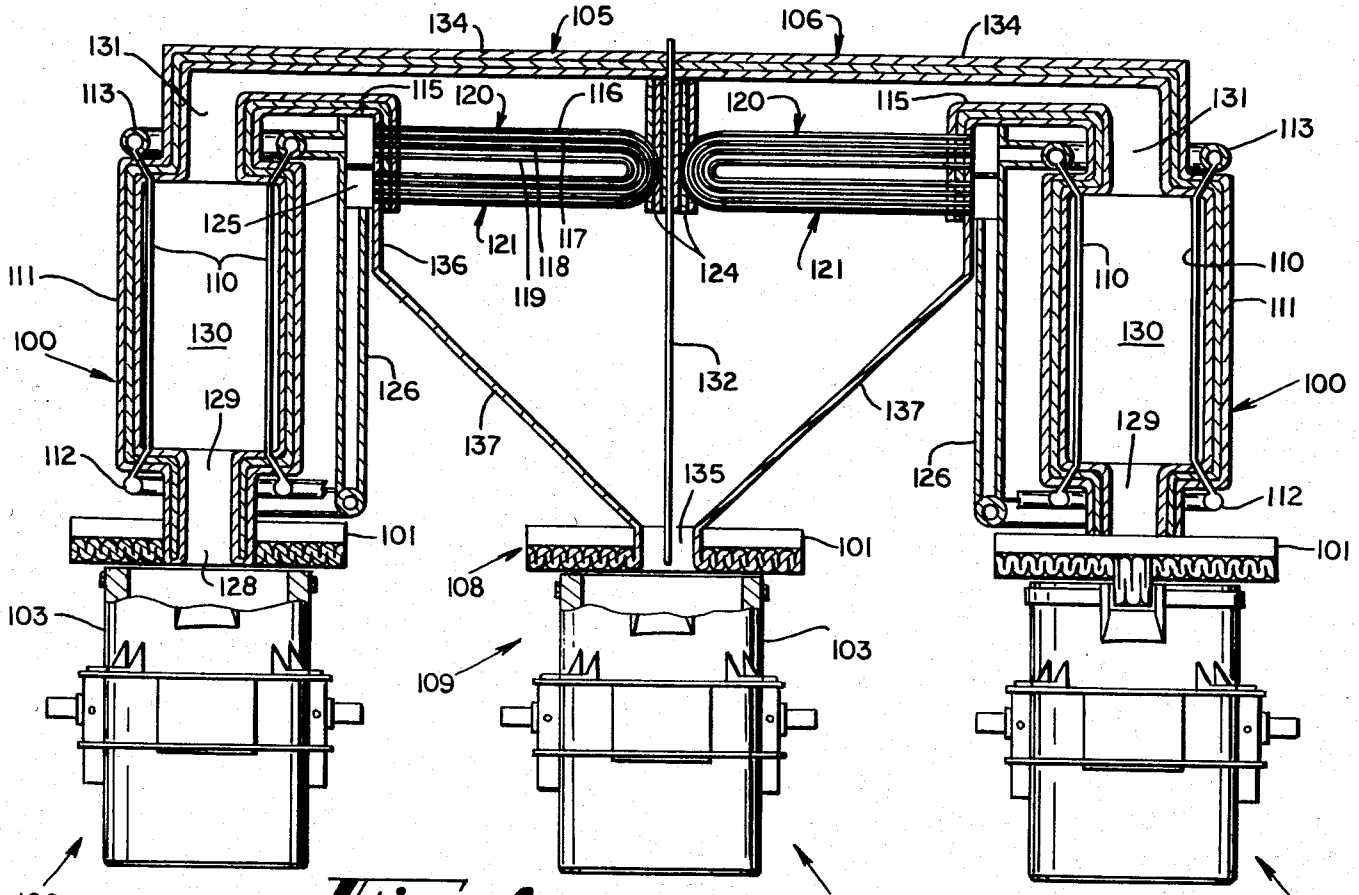
FIG. 4 is a side cross-sectional view of a portion of a centralized ladle heating and drying system, illustrating a second embodiment of the invention.

FIGS. 4 and 5 illustrate another embodiment of the invention wherein the heat exchangers comprise a combination of a radiant recuperator 100 mounted on the lids 101 at each ladle preheating station 102 and 104, and a convection recuperator 105 and 106 mounted to the lid 108 at the ladle drying station 109. The radiant recuperators 100 comprise a cylindrical array of vertical conduits 110 positioned within a cylindrical insulated housing 111, with the heat exchange conduits 110 each extending through the insulated housing 111 at its lower and upper end portions and connected to headers 112 and 113. The lower header 112 is connected to the oncoming supply of combustion air, while the upper header 113 receives the hot air from the radiant recuperator and directs the hot air to the upper header 115 of the convection heat exchanger 105. Heat exchange conduits 116, 117, 118 and 119 extend in upper and lower banks 120 and 121 of conduits from upper header 115, across the interior space of the convection heat exchanger to partition 124, and then back across the space of the convection heat exchanger to the lower header 125, and the lower header 125 communicates with insulated conduit 126 which carries the preheated combustion air to the burner 127.

Each of the lids 101 at the ladle preheating stations 102 and 104 defines an outlet opening 128, and and exhaust conduit 129 communicates with opening 128 in the lid and directs the hot exhaust gases from the ladle 103 upwardly into the central vertical passageway 130 of the radiant recuperator 100, while a similar duct 131 communicates at the top of the radiant recuperator 110 with the vertical passageway 130 to direct the hot gases of combustion first upwardly and then laterally from the radiant recuperator over to the upper portion of the convection recuperator 105. The convection recuperator 105 includes a hollow, internal partition 132 that extends downwardly from the top insulated wall 134 to divide the convection recuperator 105 from the convection recuperator 106. Partition 132 extends into the opening 135 of the lid 108 at the drying station 109. Side wall 136 of the convection recuperator 105 extends downwardly and then converges laterally at 137 toward the opening 135 in the lid 108. With this arrangement, the hot exhaust gases are moved through the opening 128 of the lid 101 upwardly through the radiant recuperator 100, then laterally over to the upper portion of the convection recuperator 105, then downwardly about the heat exchange conduits 116–119, and then downwardly through the opening 135 of the lid 108 at the drying station. The temperature of the hot exhaust gases at the lid 101 of the preheating station 102 will range between 1400° F. and 2300° F., while the temperature of the exhaust gases moving through the opening 135 at the lid 108 of the drying station 109 will range between 200° F. and 1200° F. As with the embodiment illustrated in FIGS. 1–3, various flow control valves are utilized to regulate the volume of combustion air moving to the ladle heating stations. In addition, dilution air is moved downwardly through the hollow partition 132 that divides the convection recuperators 105 and 106 so that dilution air can be added to the hot exhaust gases entering the ladle at the drying station 109, and a flow control valve (not shown) is utilized to adjust the volume of dilution air moving to the drying station. The exhaust gases that enter the ladle at the drying station are vented back through the lid 108 through an opening (not shown) that directs the exhaust gases upwardly.

Figure 6:
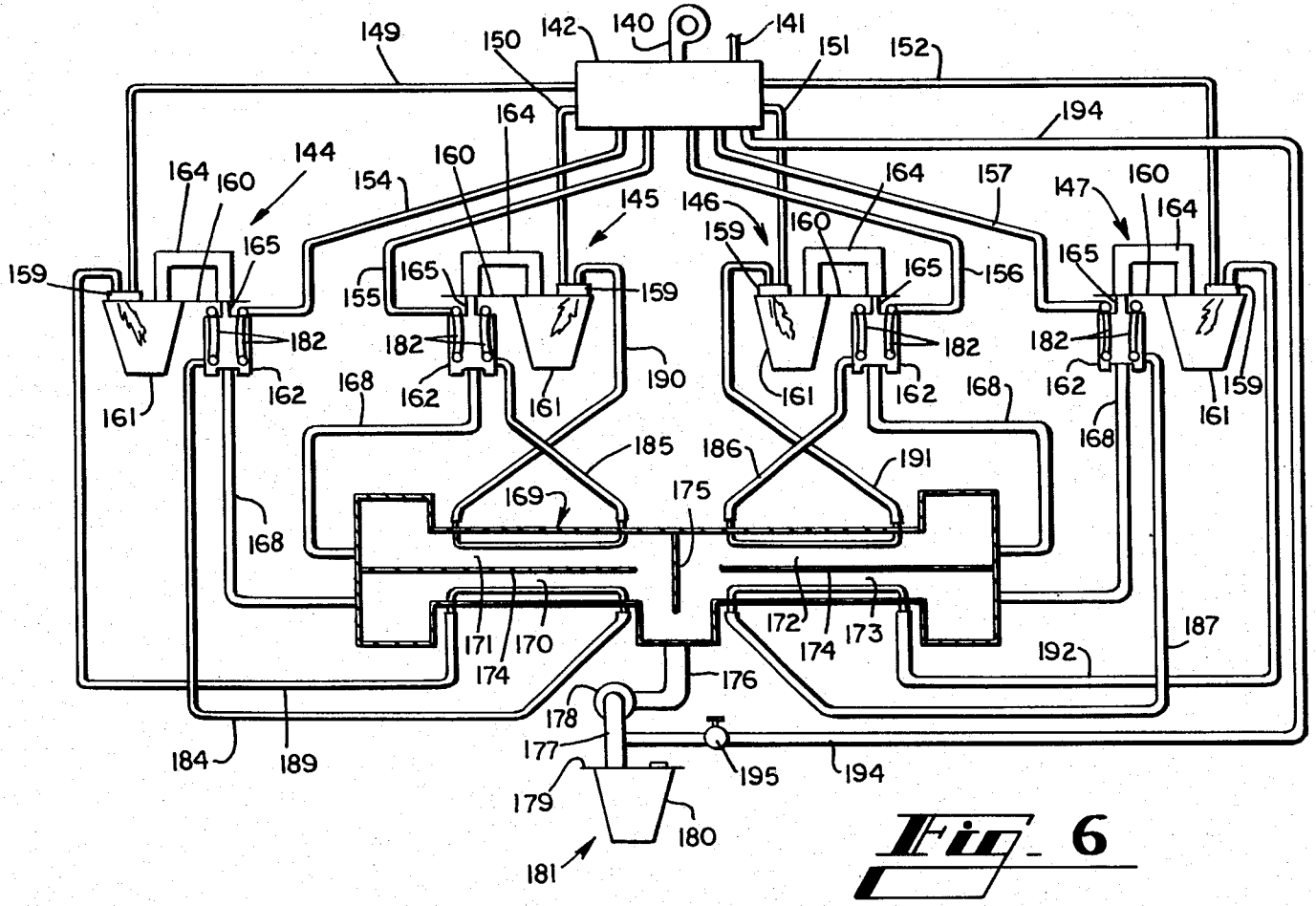
FIG. 6 is a schematic illustration of a centralized ladle heating an drying system, showing another embodiment of the invention.

FIG. 6 illustrates another embodiment of the invention, wherein the radiant recuperator is not mounted to the ladle lid, but the ladle is movable with respect to the recuperator as it moves toward and away from the rim of a ladle. In a structure similar to that illustrated in FIG. 1, air blower 140 and fuel supply line 141 supply air and fuel to the fuel-air control 142, and fuel and air are directed to ladle preheating stations 144, 145, 146 and 147 through fuel conduits 149, 150, 151 and 152, and through combustion air conduits 154, 155, 156 and 157. The combustion air and fuel are mixed in a burner 159 mounted on each lid 160 at each preheating station. This generates an open flame within each ladle 161 at each station. The radiant recuperators 162 at each preheating station are stationary, and each lid 160 includes an inverted U-shape insulated conduit 164 that communicates with one end through an opening in the lid 160 and at its other end to the passageway through the radiant recuperator 162. The conduit 164 is telescopically mounted to a collar 165 of each radiant recuperator 162, so that the U-shaped conduit 164 can be raised and lowered without breaking communication with the recuperator as the lid 160 moves toward and away from engagement with the rim of the ladle 161.

The hot exhaust gases that are moved through the radiant recuperators 162 then move through exhaust gas conduits 168 to the ends of the centralized recuperator 169. Centralized recuperator 169 includes heat exchange chambers 170, 171, 172 and 173 formed by horizontal partitions 174, all of which direct the exhaust gases inwardly toward central partition 175 and then downwardly through insulated conduit 176, through fan 178 and its delivery conduit 177 and through lid 179 into the ladle 180 at drying station 181.

In the meantime, combustion air from combustion air conduits 154, 155, 156 and 157 is directed through the internal conduits 182 of the radiant recuperators 162 at each drying station, and the combustion air is then directed from the radiant recuperators 162 through insulated conduits 184, 185, 186 and 187 to the heat exchange chambers 170–173 of the centralized recuperator 169, and from the heat exchange chambers 170–173 through insulated conduits 189, 190, 191 and 192 to the burners 159 at each ladle preheating station. Therefore, the oncoming combustion air is preheated by the radiant recuperators 162 and by the centralized recuperator 169 prior to being introduced to the burners 159.

The temperature of the exhaust gases leaving each ladle at a ladle heating station will vary from about 1400° F. to about 2400° F., and after the exhaust gases have moved through the radiant recuperators 162, the temperature will be between approximately 1400° F.

and 1800° F. When the exhaust gases are adjacent partition 175 in centralized recuperator 169, and approach the outlet of the recuperator, the exhaust gases will range between 200° and 1200° F. and will enter the ladle at the drying station 181 at this temperature range.

Dilution air is moved from the fuel-air control 142 through dilution air conduit 194 through the fan delivery conduit 177 so that dilution air is mixed with the hot exhaust gases entering the ladle at the ladle drying station 181. A flow control 195 is located in dilution air conduit 194 so as to regulate the volume of dilution air added to the exhaust gases. This regulates the effective temperature of the exhaust gases as the gases move through the ladle lid 179 at the ladle drying station 181.

In the operation of the embodiment of the invention illustrated in FIG. 6, the ladle lids 160 at each ladle heating station are movable vertically with respect to the ladle position so as to move downwardly toward engagement with the upwardly facing rim of the ladle to make sealing emgagement with the ladle, and are movable upwardly away from the ladle so as to allow the ladle to be removed and a new cold ladle substituted therefor. The upward and downward movement of the lids 160 is accommodated by a telescoping arrangement between the ladle lids and the radiant recuperators 162, whereby the inverted U-shaped insulated conduit 164 is mounted to the ladle lid and fits about the collar 165 of the radiant recuperator. Therefore, the radiant recuperator does not have to be moved when ladles are moved into and out of position at a ladle heating station.

Since each ladle heating station includes not only its own ladle lid but also its own recuperators, one or more of the ladles can be removed from its ladle preheating station without terminating the preheating function at the other ladle heating stations, so that a continuous supply of hot exhaust gases is maintained to the ladle drying station 181. All that is required to maintain the continuous drying function is the continued preheating function at one or more of the ladle preheating stations.

Figure 7:
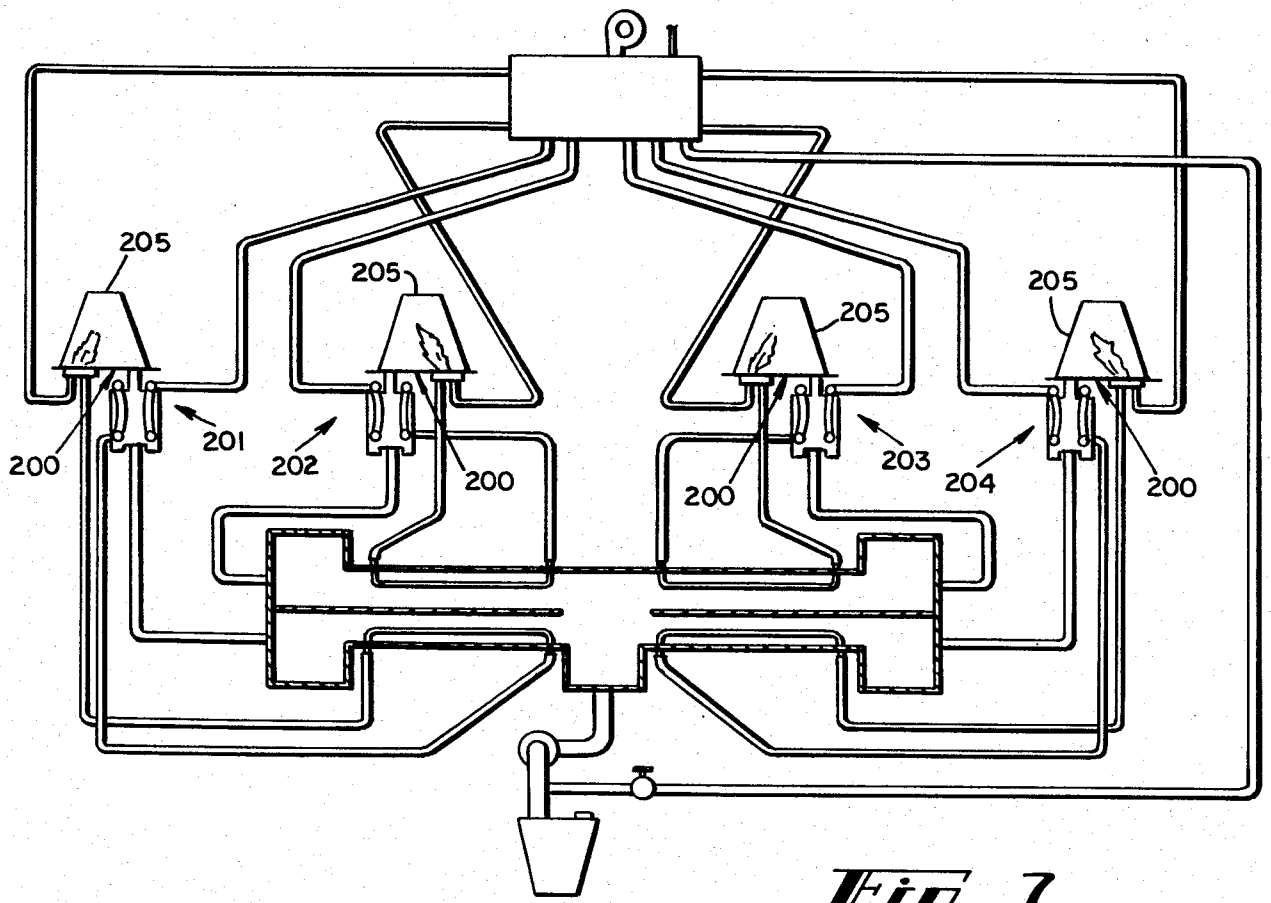
FIG. 7 is a schematic illustration of a centralized ladle heating and drying system, showing another embodiment of the invention.

FIG. 7 illustrates another embodiment of the invention wherein the lid means 200 for each ladle at each ladle preheating station 201, 202, 203 and 204 are stationary and the individual ladles are applied to each ladle lid means. The lids 200 can be oriented in a horizontal attitude and the ladle inverted and moved downwardly into sealing engagement with the lid means. In the alternative, the lid means 200 can be oriented vertically and the ladles 205 tipped over on their sides and moved laterally until their rims engage the sealing surface of the ladle means. With this arrangement, only the ladle is to be moved during the operation of the system, and no mechanical means is required to move the lid toward or away from engagement with the rim of the ladle.

Figure 8:
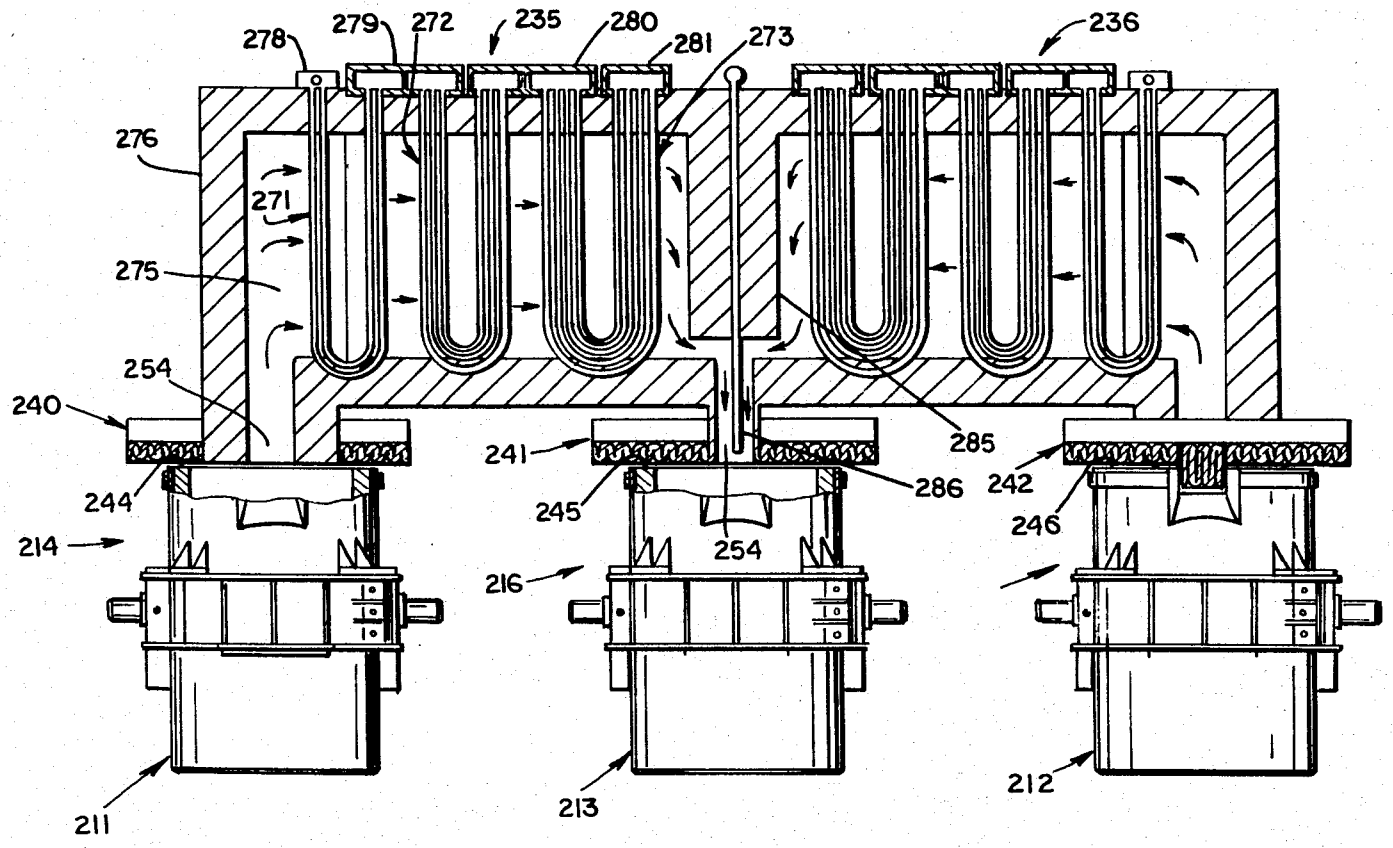
FIG. 8 is a side elevational view, with portions shown in cross-section, of another embodiment of a centralized ladle heating and drying system.
Figure 9:
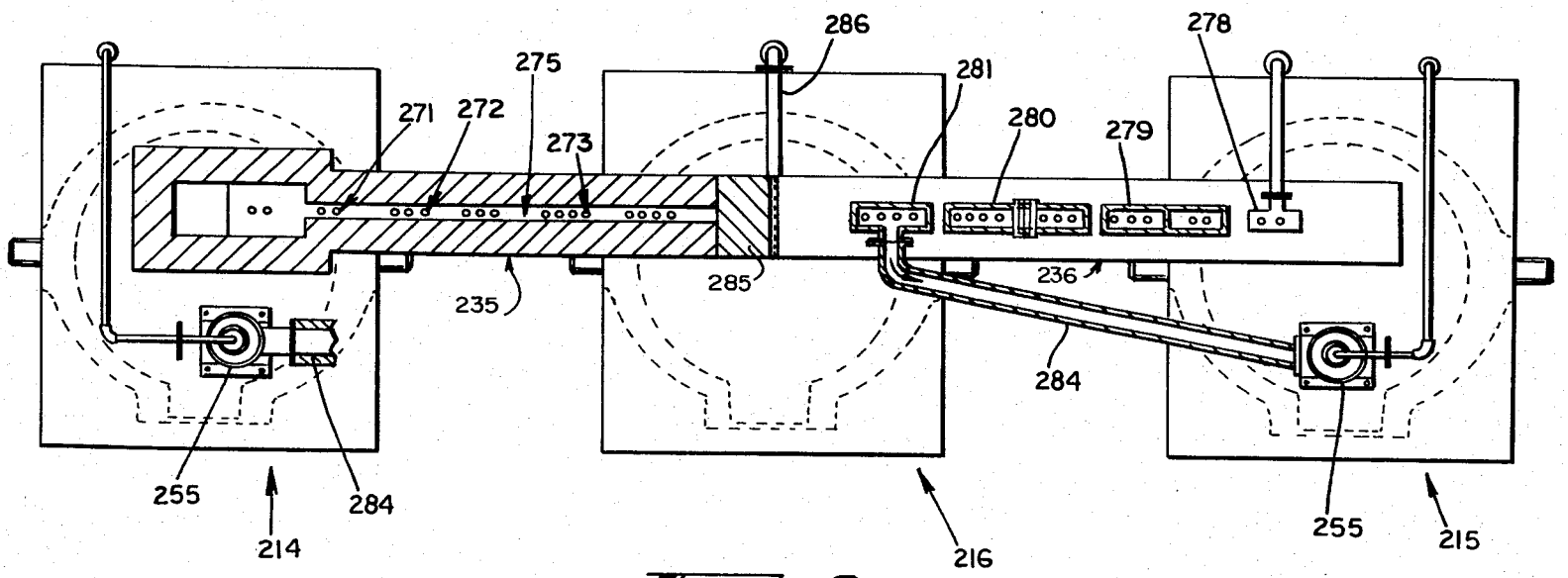
FIG. 9 is a top view of the centralized ladle heating and drying system of FIG. 8, with portions shown in cross-section.

As illustrated in FIGS. 8 and 9 of the drawing, a modified version of the embodiments of FIGS. 2 and 3 includes ladles 211, 212 and 213 positioned at a centralized ladle heating station, with centralized heat exchangers 235 and 236 rigidly mounted to the ladle lids 240, 241 and 242 which are to be applied to the rims 244, 245 and 246 of the ladles. An opening 254 is formed in each lid for the movement therethrough of hot gases. Burners 255 (FIG. 9) are mounted on each lid at a preheating station 214, 215 for receiving the fuel and combustion air and directing the mixture of fuel and combustion air through the lids at the preheating stations so as to generate a flame that is directed inwardly of the ladles at the preheating stations. The exhaust gases from the ladles at each preheating station 214 and 215 are directed through the opening 254 of its lid, through the heat exchangers 235, 236, and then through opening 254 and into the ladle 213 at the drying station 216. The exhaust gases from the ladle at the drying station are moved back through an opening (not shown) in the ladle lid and are directed upwardly to the atmosphere. This is similar to the embodiment illustrated in FIGS. 2 and 3.

In the embodiment illustrated in FIGS. 8 and 9, the heat exchangers 235 and 236 each include U-shaped banks of heat exchange conduits 271, 272 and 273, with each bank comprising U-shaped conduits extending across the passageway 275 of the housing 276. The first bank 271 of conduits comprises two U-shaped conduits, the second bank 272 of conduits comprises three U-shaped conduits, while the third bank 273 of conduits comprises four conduits. Headers 278, 279, 280 and 281 are formed at the ends of the banks of heat exchange conduits, with the header 278 directing ambient air to the heat exchanger, and with header 281 in communication with an insulated conduit 284 for directing the preheated combustion air to the burner 255 (FIG. 9).

Inwardly projecting partition 285 separates heat exchanger section 235 from heat exchanger section 236, and dilution air conduit 286 projects through partition 285 downwardly into the opening 254 in lid 241. Dilution air conduit 286 functions as a divider so as to limit the movement of hot gases between the two heat exchange sections 235 and 236.

Figure 10:
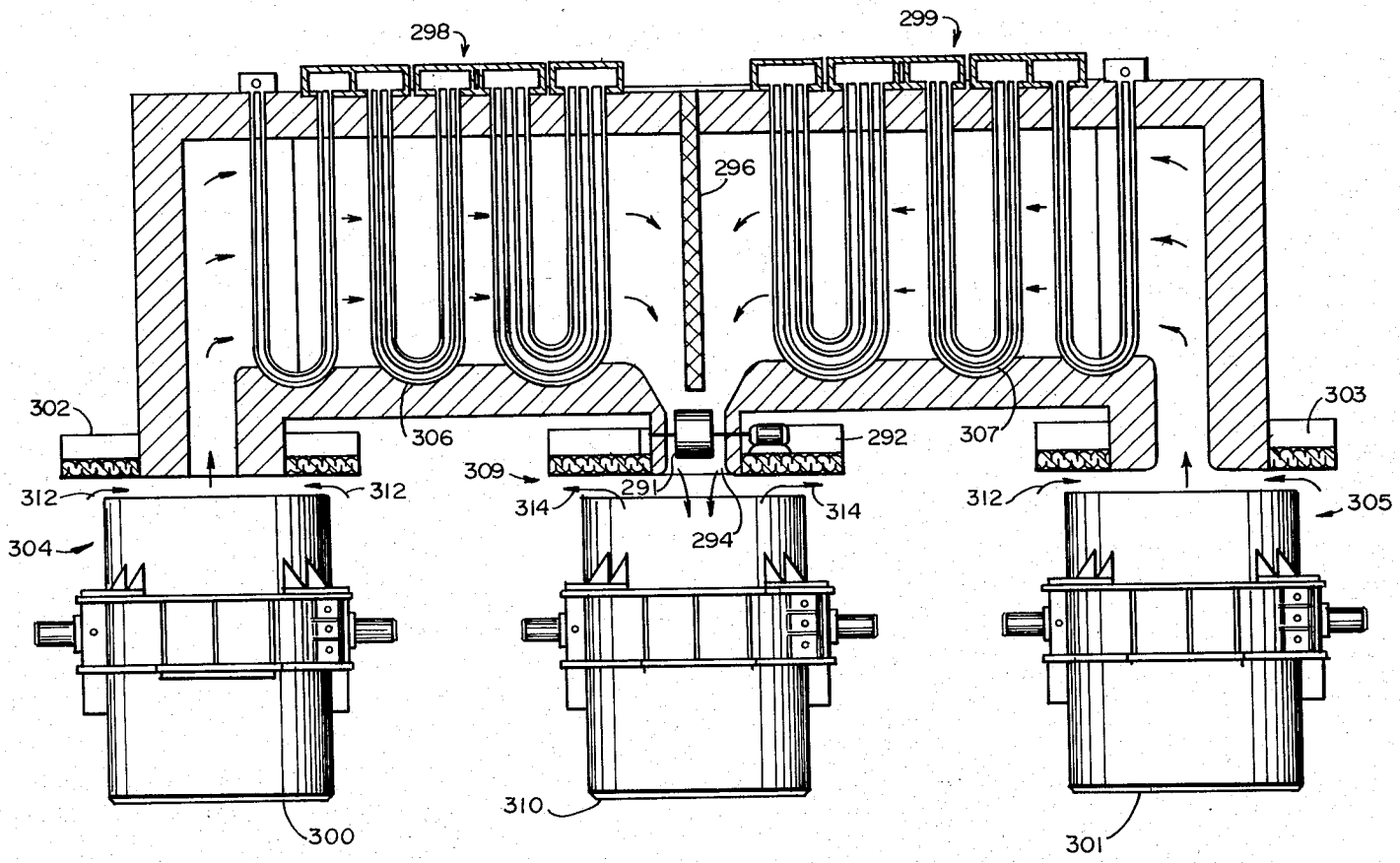
FIG. 10 is a side elevational view, similar to FIG. 8, of another embodiment of the centralized ladle heating and drying system.
Figure 11:
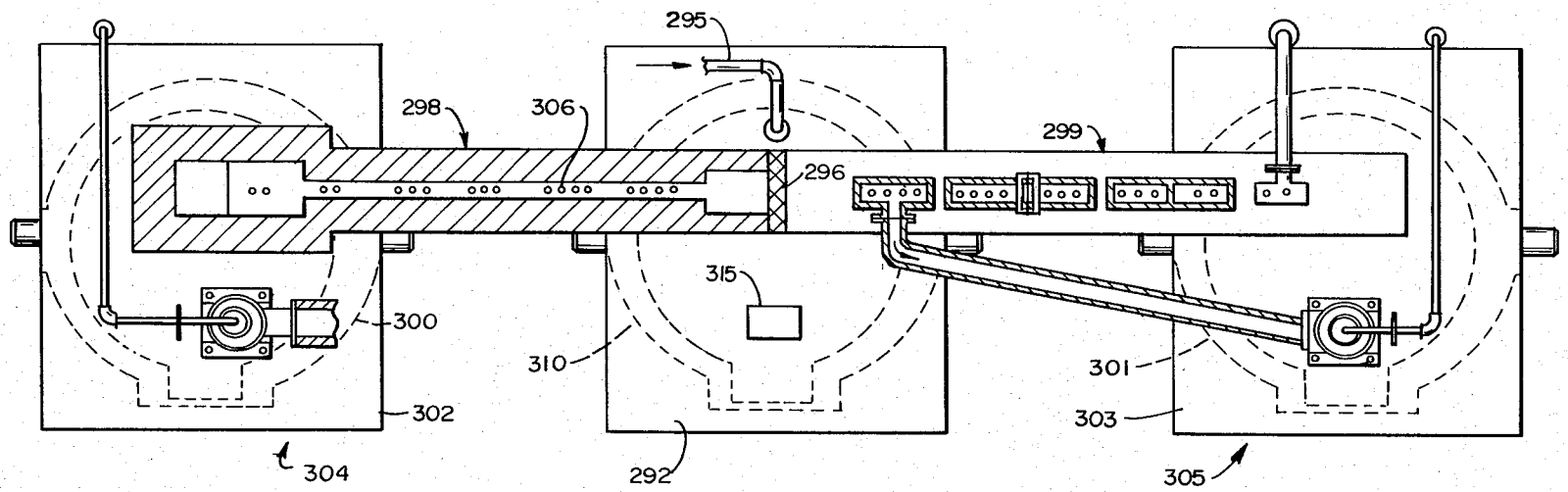
FIG. 11 is a top view of the centralized ladle heating and drying system of FIG. 10, with portions shown in cross-section.

As illustrated in FIGS. 10 and 11, the embodiment of FIGS. 8 and 9 can be modified to include a blower 291 mounted in opening 294 in lid 292. Also, the dilution air can be moved directly through drying lid 292 by dilution air conduit 295 (FIG. 11). Partition 296 divides the chambers of heat exchangers 298, 299 from each other so that blower 291 draws the gases of combustion from the ladles 300 and 301 through the lids 302 and 303 at the ladle heating stations 304 and 305, through the heat exchangers 298 and 299 about the banks of heat exchange tubes 306 and 307, and expels the gases downwardly through the lid 292 into the ladle 310. The blower 291 is controlled to create a negative pressure at the lids 302 and 303 at the ladle drying stations 304 and 345. Therefore, if either of the ladles 300 or 301 at the ladle heating stations have rims that cannot be sealed by the lids 302 or 303 because of the configuration of the ladle rims, or because of chips or cracks in the rims, or because of a buildup of slag on the rims, negative air pressure at the lids 302 and 303 reduces the likelihood that the gases of combustion from the ladles at the ladle heating stations 304 and 305 will be lost to the atmosphere, and the hot gas will be drawn through the heat exchangers 298 and 299 to the ladle drying station 309. Also, some atmospheric air will be drawn in about the rim of the ladles 300, 301 as indicated by arrows 312.

Any atmospheric air drawn into the system at the ladle drying stations tends to reduce the temperature of the gases moved through the heat exchangers and tends to increase the mass of gases moved through the heat exchangers. The added mass tends to create more turbulence and therefore more efficient heat exchange in the heat exchangers, thereby compensating for the reduction in temperature of the gases.

The lid 292 at the ladle drying station 309 also might not form an effective seal against the rim of the ladle 310, and some of the gases expelled into the ladle might be exhausted to the atmosphere, as indicated by arrows 314. The flue 315 (FIG. 11) which communicates through ladle lid 292 with the ladle at the drying station can include an exhaust blower (not shown) to reduce the pressure in the ladle at the drying station, so as to reduce the escape of hot gases in the vicinity of the ladle drying station.

While the embodiments of the invention have been described in association with a ladle for receiving molten metals, it will be understood that other receivers can be preheated and/or dried with this invention. Moreover, while this invention has been described in detail with particular reference to preferred embodiments thereof, it will be understood that variations and modifications can be effected within the spirit and scope of the invention as described hereinbefore and as defined in the appended claims.

I claim:

1. A method of simultaneously preheating a plurality of ladles and curing at least one other ladle comprising the steps of arranging the ladles with the rims about the openings of the ladles accessible for engagement by lids, engaging the rim of each ladle with a lid including a heat resistant material that substantially closes the ladle, moving combustion air first through a heat exchanger and then through the lids of and into the ladles to be preheated, combining fuel with the combustion air and burning the combustion air and fuel in the ladles to be preheated, moving the exhaust gases from the ladles being preheated through the lids of each ladle and through the heat exchanger, directing the exhaust gases moved through the heat exchanger through the lid of and into the ladle to be cured, and exhausting the gases from the ladle to be cured.

2. The method of claim 1 and wherein the step of moving the combustion air through a heat exchanger comprises moving the combustion air first through a heat exchanger mounted to the lid of each ladle, and wherein the step of moving the exhaust gases from the ladles being preheated comprises moving the exhaust gases through the lid of the ladle and through the heat exchanger mounted to the lid of the ladle.

3. The method of claim 1 and further including the step of adding controlled amounts of dilution air to the exhaust gases introduced to the ladle that is being cured to provide a controlled rate of curing.

4. The method of claim 1 and further including the step of adding dilution air to the exhaust gases before the exhaust gases are introduced to a heat exchanger.

5. The method of claim 1 and wherein the step of moving the exhaust gases from the heat exchanger through the lid of and into the ladle to be cured comprises moving exhaust gases from at least two heat exchangers through the lid of and into one ladle to be cured.

6. The method of claim 1 and wherein the step of directing the exhaust gases moved through the heat exchanger through the lid of the ladle being cured comprises moving the exhaust gases from a ladle being preheated at a temperature up to about 2200° F., and further comprising the step of adding dilution air at a varying rate to the exhaust gases as the exhaust gases are moved to the ladle to be cured to adjust the temperature of the exhaust gases entering the ladle to be cured to follow a schedule of curing the refractory of the ladle.

7. The method of claim 1 and wherein the step of moving the exhaust gases from the ladles being preheated through the lids of each ladle and through the heat exchanger comprises forming a zone of reduced pressure at the lid of the ladles being preheated so that if any leakage occurs at the rim of the ladle atmospheric air will be drawn between the ladle rim and the lid, through the lid and moved with the gases of combustion through the heat exchanger.

8. A method of simultaneously and independently preheating a plurality of ladles with open flames and utilizing the exhaust gases from the ladles being preheated to preheat the oncoming combustion air and to cure at least one ladle at a lower temperature, comprising the steps of arranging the ladles in a group with their openings accessible for engagement by a lid, engaging the rim of each ladle to be preheated with a lid to substantially close each ladle, moving combustion air from a common supply through a heat exchanger at each lid of a ladle to be preheated, preheating the combustion air in the heat exchangers, moving the preheated combustion air from each heat exchanger through the lid of the heat exchanger and into a ladle to be preheated, combining fuel with the combustion air at each lid of a ladle to be preheated and burning the fuel and combustion air in the ladles to be preheated, moving the exhaust gases from the ladles being preheated through the lid of each ladle and through the heat exchanger of the lid, and moving the exhaust gases from the heat exchangers through a lid to be applied to a ladle to be cured.

9. The method of claim 8 and further including the step of introducing controlled amounts of dillution air into the exhaust gases to be applied to a ladle to be cured for providing the required temperature schedule of ladle curing.

10. The method of claim 8 and further including the step of disengaging the lid and the rim of one or more ladles that have been preheated while continuing to preheat others of said ladles and continuing to cure at least one ladle.

11. A method of simultaneously heating a plurality of ladles or the like comprising the steps of arranging the ladles with their openings accessible for engagement by a lid, engaging the rim of each ladle with a lid that substantially closes the opening of each ladle, moving combustion air and fuel through the lid of at least one ladle into the ladle and burning the combustion air and fuel in the one ladle, moving the exhaust gases from the at least one ladle through its lid and through the lid of and into a second ladle, and exhausting the gases from the second ladle.

12. The method of claim 11 and further including the step of adding dilution air to the exhaust gases received in the second ladle to reduce the temperature of the gases in the second ladle.

13. The method of claim 11 and wherein the step of engaging the rim of each ladle with a lid comprises engaging the rims of the ladles with a ceramic fiber material that substantially closes the opening of each ladle.

14. A method of simultaneously heating a plurality of ladles or the like comprising the steps of engaging the rim of each ladle with a lid including a heat resistant soft fibrous material that substantially closes the ladle, moving combustion air and fuel through the lid of at least one ladle and into the ladle and burning the combustion air and fuel in the one ladle, moving the exhaust gases from the at least one ladle through the lid of and into a second ladle, and exhausting the gases from the second ladle.

15. The method of claim 14 and further including the step of adding diution air to the exhaust gases received in the second ladle to reduce the temperature of the gases in the second ladle.

16. Apparatus for simultaneously preheating at least two ladles to releatively high temperatures and curing at least one ladle at a relatively low temperature comprising a lid to be applied to the rim of each ladle to be preheated, a lid to be applied to the rim of each ladle to be cured, a heat exchanger assembly mounted to the lids of the ladles to be preheated, means for supplying combustion air through the heat exchanger assembly and through its lids and to the ladles to be preheated, means for supplying fuel to the combustion air as the combustion air is moved into the ladles to be preheated so that the combustion air and fuel is burned in the ladles to be preheated, and means for directing the exhaust gases from the ladles being preheated through their lids and heat exchanger assemblies to the ladle to be cured.

17. The apparatus of claim 16 and further including means for controlling the temperature of the exhaust gases entering the ladle to be cured comprising means for adding dilution air at a controlled rate to the exhaust gases as the exhaust gases move from the heat exchanger assembly into the ladle to be cured.

18. The apparatus of claim 16 and wherein each lid to be applied to the rim of a ladle to be preheated is movable with respect to its heat exchanger assembly and comprises a soft refractory fiber seal surface for engaging the rim of a ladle, whereby the lid can be moved with respect to its heat exchanger assembly and with respect to its ladle when moving toward or away from engagement with the rim of a ladle.

19. The apparatus of claim 16 and wherein the heat exchanger assembly for each lid to be applied to the rim of a ladle to be preheated comprises a radiative recuperator comprising an array of heat exchange tubes arranged about an exhaust gas passageway for moving combustion air through the heat exchange tubes about the exhaust gas.

20. The apparatus of claim 16 and wherein the heat exchanger assembly for each lid to be applied to the rim of a ladle to be preheated comprises a radiative recuperator mounted on a lid and including an array of heat exchange tubes arranged about an exhaust gas passageway for moving combustion air through the heat exchange tubes about the exhaust gas.

21. The apparatus of claim 16 and wherein the means for collecting and directing the exhaust gases from the ladles being preheated through their lids and heat exchanger assemblies to the ladle to be cured comprises blower means for creating a zone of reduced pressure upstream of the ladle being cured so that any leakage between the rims of the ladles being preheated and their lids results in atmospheric air being drawn between the rim of the ladle being preheated and the lid.

22. A centralized ladle heating and drying assembly for simultaneously preheating some ladles to a relatively high temperature while curing other ladles to a releatively low temperature comprising:

preheater lid means including a refractory ceramic fiber surface for engaging the rims and closing the ladles to be preheated, curing lid means for engaging the rims and closing the ladles to be cured, heat exchanger means for each preheater lid means, an open flame burner mounted to each preheater lid means for directing a flame from the lid means into a ladle to be preheated, combustion air conduit means for directing combustion air through the heat exchanger and then to the open flame burner of the preheater lid means, fuel conduit means for directing fuel to each burner, exhaust conduit means for directing exhaust gases from each ladle being preheated and through its preheater lid means and heat exchanger means and through a common curing lid means and into a ladle to be cured.

23. The centralized ladle heating and curing assembly of claim 22 and wherein there are at least two preheater lid means for every curing lid means, whereby one of the preheater lid means can function to preheat a ladle and supply exhaust gases to said dryer lid means while the other preheater lid means can become inoperative.

24. The centralized ladle heating and drying assembly of claim 22 further including blower means for drawing gases of combustion through said heat exchanger means and expelling the gases of combustion through said curing lid means.

25. A centralized ladle heating and drying assembly for simultaneously preheating at least two ladles and curing at least one other ladle comprising a plurality of ladle preheating assemblies with each ladle preheating assembly comprising a lid for engaging the upwardly facing rim about the opening of a ladle to be preheated, a heat exchanger, a burner mounted on said lid, combustion air conduit means for directing a stream of combustion air through said heat exchanger and then through said burner, fuel conduit means for adding fuel to the preheated combustion air in said burner, and exhaust gas conduit means communicating through said lid with the interior of the ladle and for directing exhaust gases through said heat exchanger, a ladle curing assembly for at least two ladle preheating assemblies comprising a lid for engaging the rim about the opening of a ladle to be dried, and conduit means for directing exhaust gases from the heat exchangers of at least two ladle preheating assemblies through the lid of the ladle curing assembly to the ladle to be cured.

26. The centralized ladle heating and curing assembly of claim 25 and further including temperature control means for adding dilution air in regulated amounts to the exhaust gases directed through the lid of the ladle curing assembly.

27. A ladle heating and curing apparatus for simultaneously preheating one ladle to a relatively high temperature and curing another ladle to a lower temperature comprising a ladle preheating assembly including a lid with a heat resistant surface for engaging and closing the rim of a ladle to be preheated, heat generating means mounted to said lid for forming a source of heat in the ladle, and an exhaust opening formed in said lid, a heat exchanger, including first air duct means for directing ambient air through the heat exchanger and the lid of said ladle preheating assembly to the ladle being preheated, and second air duct means for directing hot exhaust gases from the ladle being preheated through the lid of said ladle preheating assembly and through the heat exchanger and in heat exchange relationship with the ambient air, a ladle curing assembly including a lid for engaging and closing the rim of a ladle to be cured, and air duct means for directing exhaust gases from the heat exchanger through the lid of said ladle curing assembly.

28. The ladle heating system of claim 27 and further including blower means for drawing the exhaust gases through said heat exchanger and expelling the gases of combustion through the lid of said ladle curing assembly.

29. The ladle heating system of claim 27 and wherein said ladle preheating assembly, said heat exchanger and said ladle curing assembly are constructed and arranged to be movable in unison toward and away from the upwardly facing rims of the ladles.

30. A ladle heating system for simultaneously heating ladles and the like that are arrangeed with their rims accessible for engagement by lids comprising at least two ladle lids movable with respect to the rims of the ladles to be heated to close the ladle opening, heat generating means mounted to one of said lids for forming a source of heat in the ladle engaged by the said one lid, an exhaust opening formed in said one lid, and exhaust duct means for directing hot gas from the exhaust opening from said one lid through a second lid and into a second ladle whereby the second ladle is heated by the hot gas exhausted from the first ladle and directed by the exhaust duct means into the second ladle.

31. The ladle heating system of claim 30 and further including inlet air duct means in communication with said heat generating means for supplying air to the said one lid, and a heat exchanger in communication with said inlet air duct means and said exhaust duct means for preheating the air moved through the inlet duct means with the heat of the hot gas exhausted from the first ladle.

32. The ladle heating system of claim 30 and further including means for forming a zone of reduced air pressure at said one lid so that if any leakage of atmospheric air occurs between the rim of the one ladle and said one lid the atmospheric air will be drawn between the ladle rim and the lid and through the lid.

* * * * *

UNITED STATES PATENT AND TRADEMARK OFFICE

CERTIFICATE OF CORRECTION

PATENT NO. : 4,494,927

DATED : January 22, 1985

INVENTOR(S) : Grigory M. Gitman

It is certified that error appears in the above-identified patent and that said Letters Patent is hereby corrected as shown below:

The term of this patent subsequent to February 21, 2001, has been disclaimed.

Signed and Sealed this

*Third* Day of *September 1985*

[SEAL]

*Attest:*

DONALD J. QUIGG

*Attesting Officer* *Acting Commissioner of Patents and Trademarks - Designate*